US007950177B2

(12) United States Patent
Laney et al.

(10) Patent No.: US 7,950,177 B2
(45) Date of Patent: May 31, 2011

(54) BOLT ACTION FIREARM

(75) Inventors: Mark C. Laney, Lee, NH (US); Matthew Zglobicki, Acton, ME (US)

(73) Assignee: Thompson/Center Arms Company, Inc., Springfield, MA (US)

( * ) Notice: Subject to any disclaimer, the term of this patent is extended or adjusted under 35 U.S.C. 154(b) by 219 days.

(21) Appl. No.: 12/346,479

(22) Filed: Dec. 30, 2008

(65) Prior Publication Data

US 2010/0162605 A1 Jul. 1, 2010

(51) Int. Cl.
*F41A 3/00* (2006.01)

(52) U.S. Cl. ..... 42/14; 42/16; 42/69.02; 89/180; 89/185

(58) Field of Classification Search ..... 42/69.02, 42/16, 19; 89/180, 185
See application file for complete search history.

(56) References Cited

U.S. PATENT DOCUMENTS 4,169,329 A * 10/1979 Atchisson ..... 42/16
4,312,146 A 1/1982 Koon, Jr.
6,637,142 B1 * 10/2003 Reynolds ..... 42/75.03

OTHER PUBLICATIONS

Articles—Thompson/Center, New-Age Icon from Shooting Illustrated, Mar. 1, 2007, pp. 1-4.
Icon—Thompson/Center, The New Era Has Begun, Dec. 9, 2008, pp. 1-4.
Lipsey's Exclusive Thompson/Center 7mm-08 Icon Bolt-Action Rifle by Jeff Quinn, Sep. 30, 2008, pp. 1-10.
Ruger 10/22 Autoloading Rifles, Ruger Arms Makers For Responsible Citizens, Nov. 26, 2008, pp. 1-2.
Rifle—Wikipedia, The Free Encyclopedia, Aug. 12, 2008, pp. 1-7.
Bolt Action—Wikipedia, The Free Encyclopedia, Sep. 12, 2008, pp. 1-7.
T/C Goes Long, by Greg Rodriguez, Apr. 17, 2008, pp. 1-6.

* cited by examiner

*Primary Examiner* — J. Woodrow Eldred
(74) *Attorney, Agent, or Firm* — McCormick, Paulding & Huber LLP

(57) ABSTRACT

A bolt action firearm includes a bolt assembly with a bolt body having an outer surface defining a longitudinal guide channel extending along a length of the bolt body from a rearward end to a forward end. A receiver defines a central longitudinally extending bore for accommodating the bolt body. A bolt guide is configured to be coupled to the receiver. The bolt guide includes a projection configured for traveling in the guide channel when moving the bolt body in the receiver so as to ensure that the bolt body is at a predetermined correct angular orientation within the receiver.

15 Claims, 10 Drawing Sheets

BOLT ACTION FIREARM

CROSS-REFERENCE TO RELATED APPLICATION

This application is related to U.S. application Ser. No. 12/345,999 filed on Dec. 30, 2008, entitled "Firearm Magazine and Adapter Therefor", the disclosure of which is hereby incorporated by reference in its entirety.

FIELD OF THE INVENTION

The present invention is directed generally to a firearm, and more particularly to a bolt action firearm such as a rifle.

BACKGROUND OF THE INVENTION

Firearms typically have several features involving accuracy of assembly, safety and ease of use. For example, the procedure for inserting and removing the bolt assembly should be relatively quick, simple and accurate. Unfortunately, bolt assemblies often are inserted at the incorrect angular orientation which results in damaging the wood of the stock. Other features such as the bolt lock and safety should be straightforward and efficient in construction for ease of use. However, some safety and bolt locks must both be separately disengaged. This can sometimes lead to undue delay when a hunter spots prey and has to get a shot off quickly.

There is an ongoing need to improve the features of a firearm to make it more accurate to assemble, as well as easier to use.

SUMMARY OF THE INVENTION

In an aspect of the present invention, a bolt action firearm includes a bolt assembly with a bolt body having an outer surface defining a longitudinal guide channel extending along a length of the bolt body from a rearward end to a forward end. A receiver defines a central longitudinally extending bore for accommodating the bolt body. A bolt guide is configured to be coupled to the receiver. The bolt guide includes a projection configured for traveling in the guide channel when moving the bolt body in the receiver so as to ensure that the bolt body is at a predetermined correct angular orientation within the receiver.

DETAILED DESCRIPTION OF THE PREFERRED EMBODIMENT

Figure 1A:
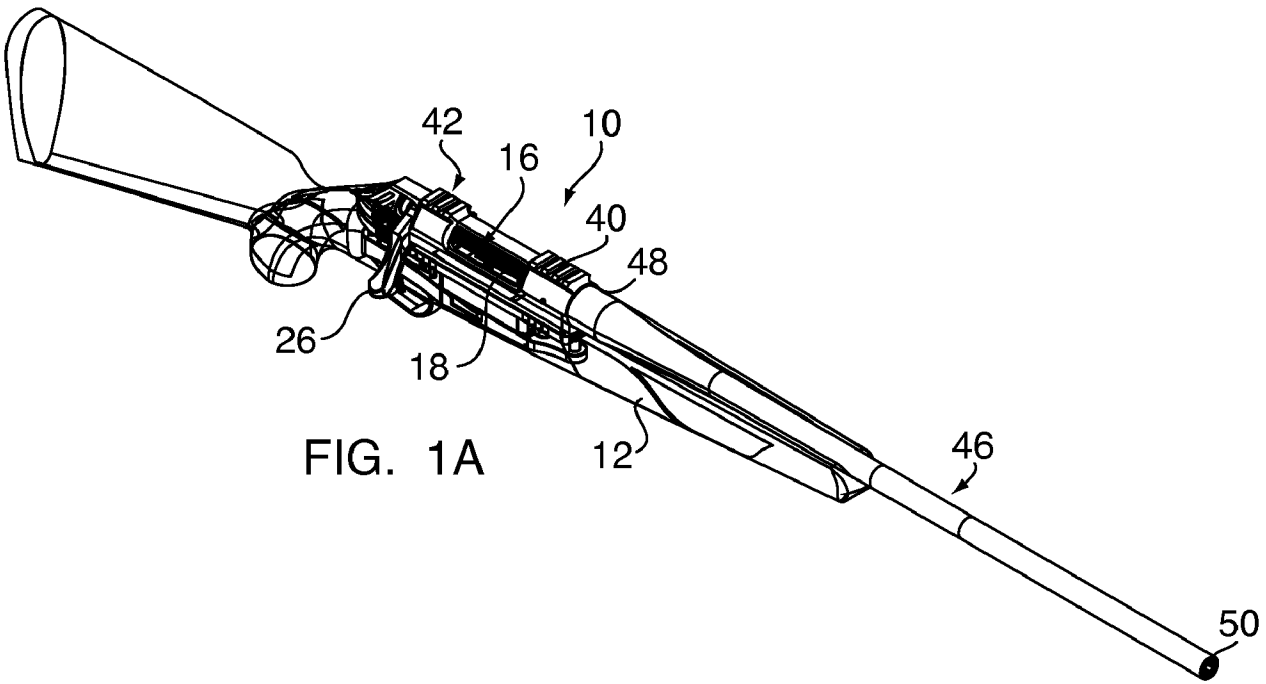
FIG. 1A is a perspective view of a long action bolt rifle embodying the present invention.
Figure 1B:
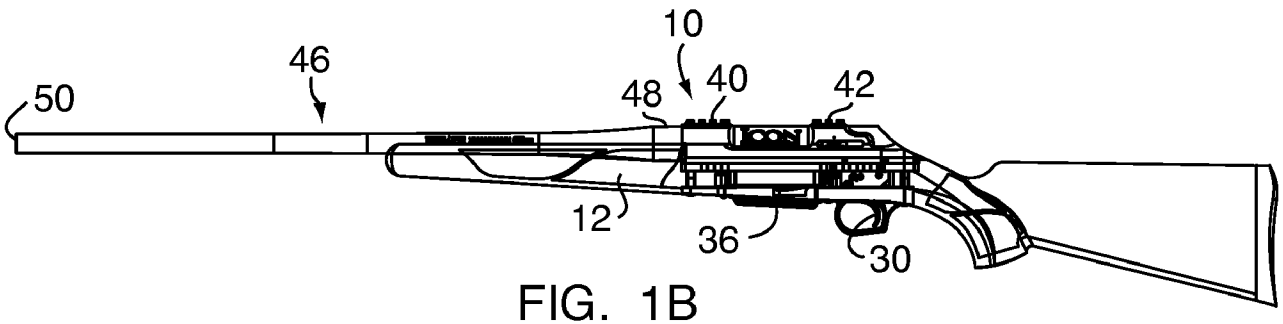
FIG. 1B is a left side elevation view of the rifle.
Figure 1C:
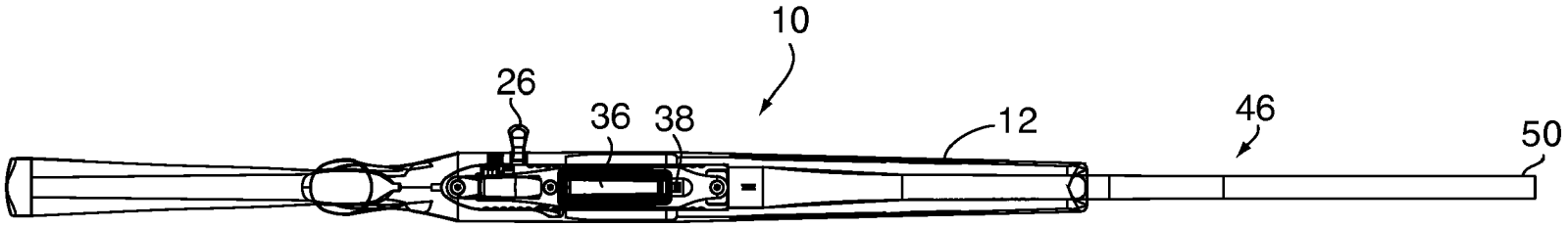
FIG. 1C is a bottom plan view of the rifle.

With reference to FIG. 1, a bolt action firearm embodying the present invention is generally indicated by the reference number 10. The firearm 10 is shown and described by way of example in the form of a medium or long action rifle, but can be other types of firearms having bolt action without departing from the scope of the present invention.

As shown in FIGS. 1-10, the firearm or rifle 10 includes, among other things, a stock 12, a bolt assembly 16 including bolt body 18, locking lugs 52, bolt handle 26, and bolt lock 28. The firearm 10 further comprises a trigger 30, a trigger guard and magazine well assembly 32 (see FIG. 9), a two-position safety 34, a magazine 36 (see FIG. 10), a magazine release latch 38, a scope mount base 40, a receiver 42, a bedding block 44, a barrel 46 including chamber 48 and muzzle 50.

Figure 4:
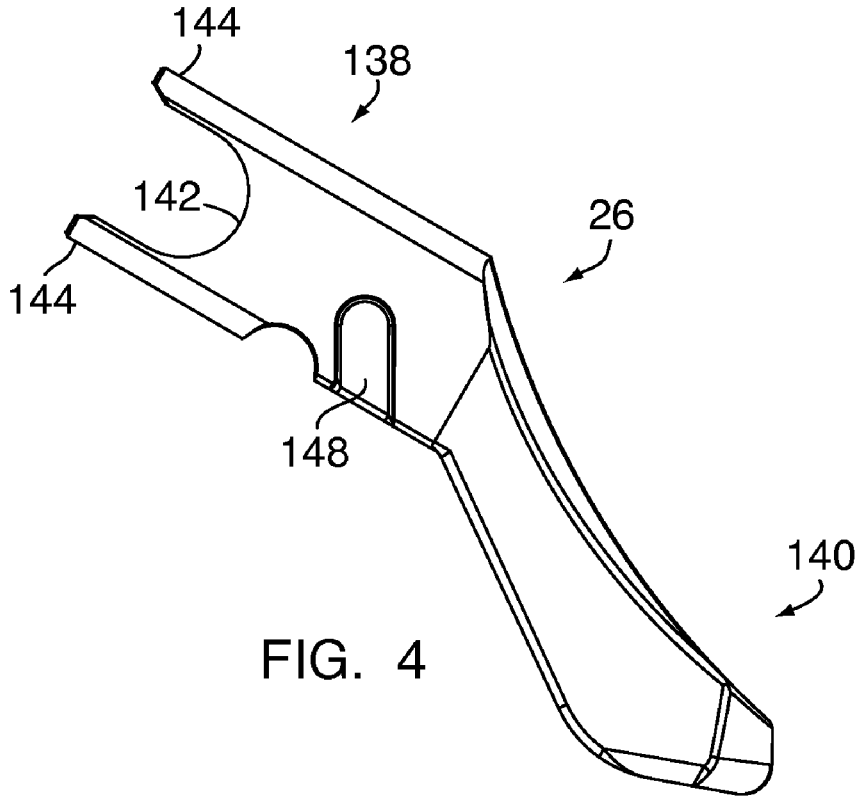
FIG. 4 is a side elevation view of a bolt handle in accordance with the present invention.

With reference to FIG. 4, the bolt handle 26 is configured to be interchangeable so as to allow the user of the firearm 10 to choose among several different bolt handle configurations and styles without requiring an entirely new bolt assembly.

The bolt assembly 16 includes three locking lugs 52 as compared to some conventional bolt assemblies which have two locking lugs. The three locking lugs 52 are configured to provide strength and has a tracking feature when the bolt body 18 is removed from or inserted into the rear of the firearm 10. The tracking feature ensures that the bolt body 18 is inserted or removed at the correct angular orientation as will be explained more fully below. Inserting the bolt body 18 at the wrong angular orientation could otherwise damage the wood of the stock 12. More specifically, the tracking feature prevents the bolt assembly 16 from gouging the wood along the bottom of a channel of the stock 12 which receives the bolt assembly, and is configured to clear the corresponding groove in the stock at the end of the receiver 42 where the two meet together. The bolt body 18 also define a small "T-slot" extractor 54 preferably milled into one of the locking lugs 52 so as to form a solid ring of steel that uniformly supports a case head.

Figure 6:
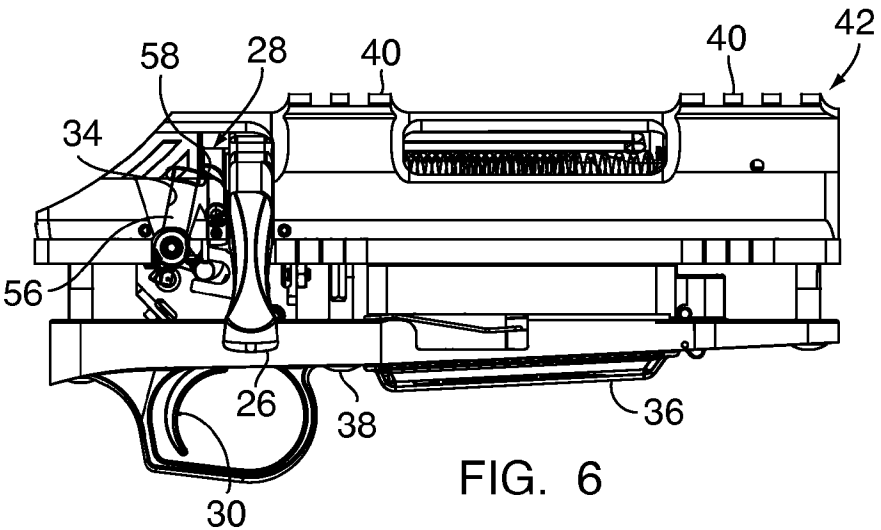
FIG. 6 is an enlarged right side elevation view of a portion of the rifle showing a bolt lock, safety and bolt handle embodying the present invention.
Figure 7A:
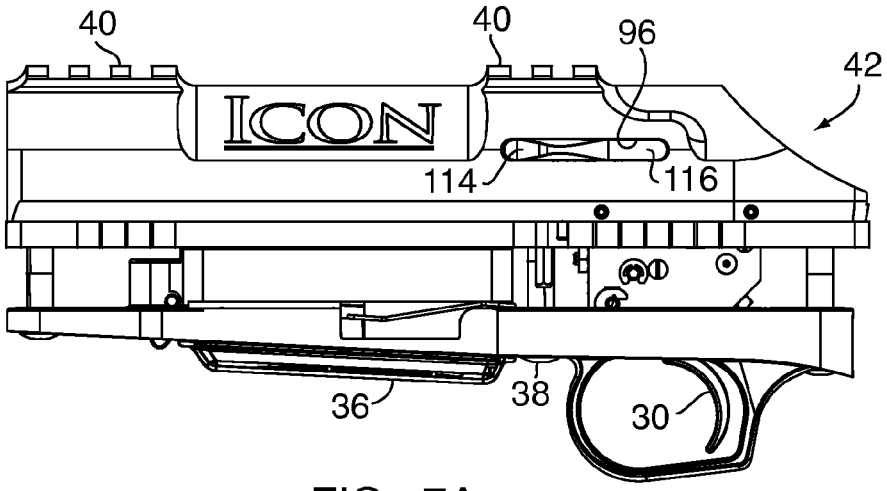
FIG. 7A is an enlarged left side elevation view of a portion of the rifle showing the bolt guide.
Figure 7B:
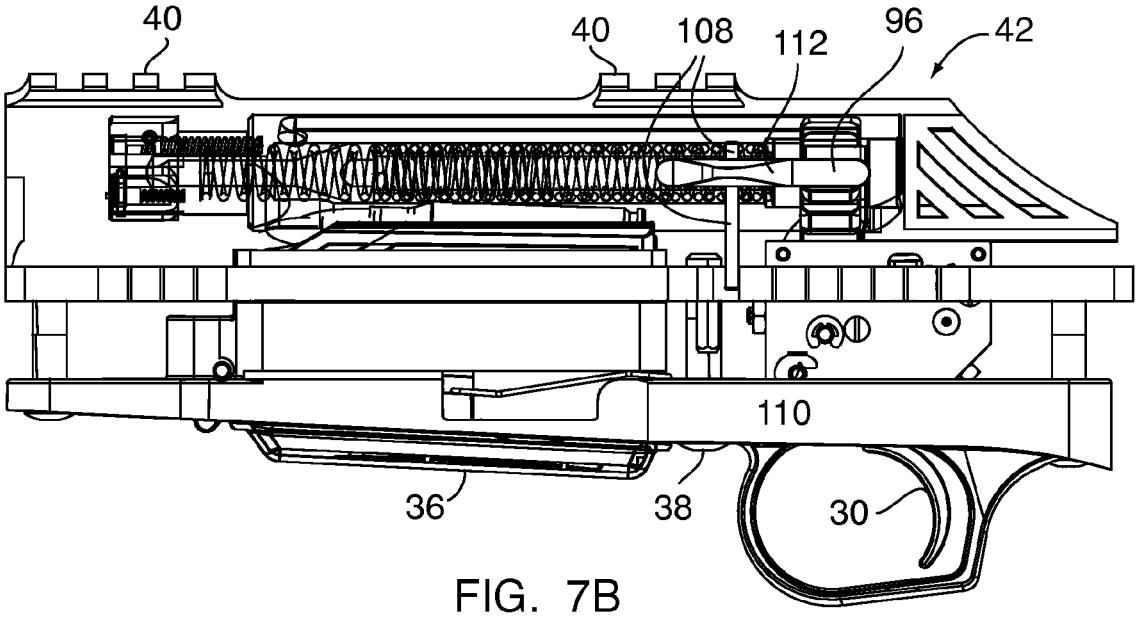
FIG. 7B is an enlarged left side elevation view of the portion of the rifle shown in FIG. 7A with the receiver being transparent to show the bolt guide components mounted on the receiver.
Figure 7C:
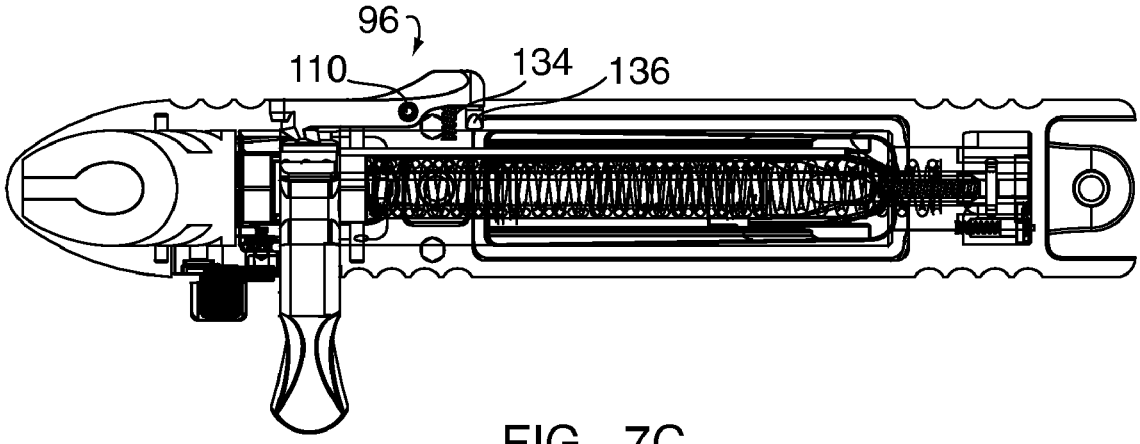
FIG. 7C is an enlarged top plan view of a portion of the rifle shown in FIG. 7A with the receiver being transparent to show the bolt guide components mounted on the receiver.
Figure 8A:
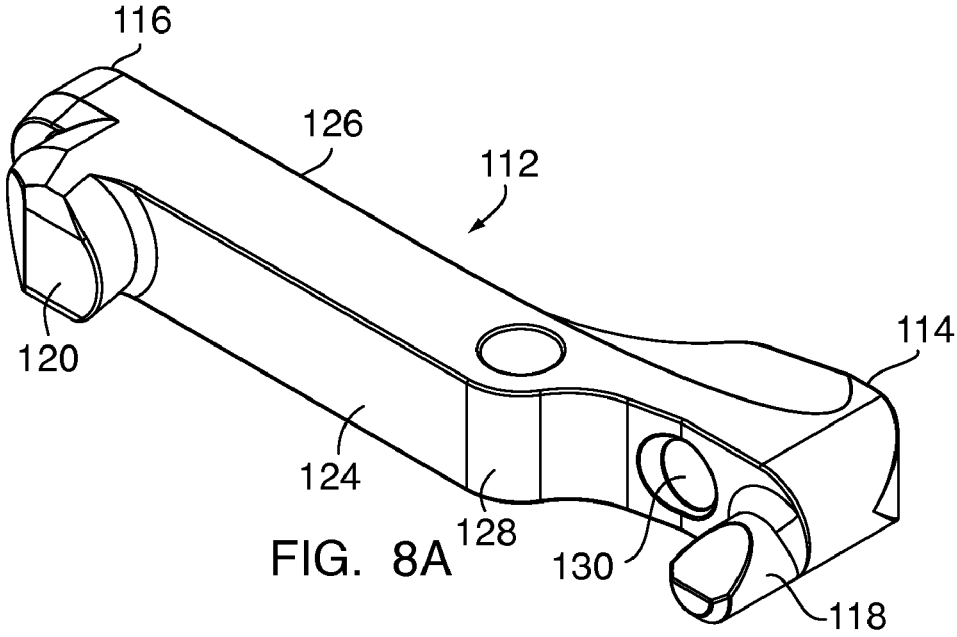
FIG. 8A is a perspective view of the body portion of the bolt guide in accordance with the present invention.
Figure 8B:
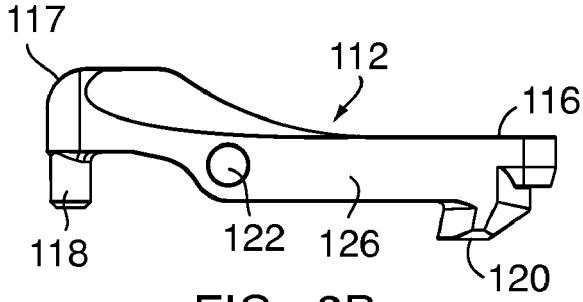
FIG. 8B is a side elevation view of the body portion of the bolt guide.
Figure 9:
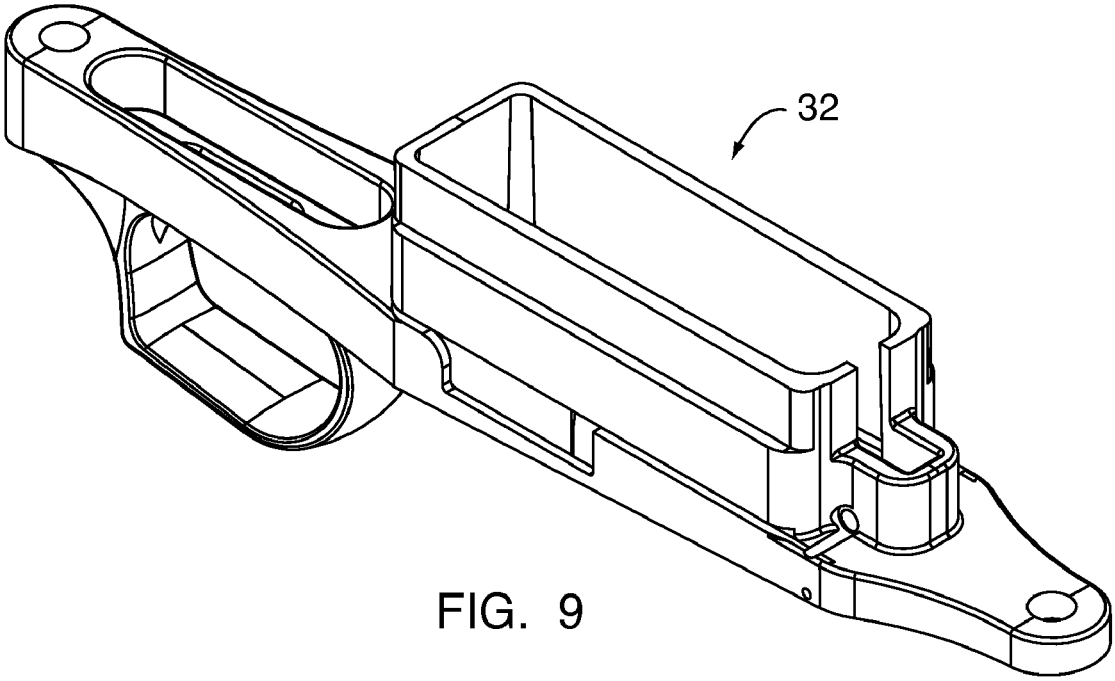
FIG. 9 is a perspective view of a trigger and magazine well assembly in accordance with the present invention.
Figure 10:
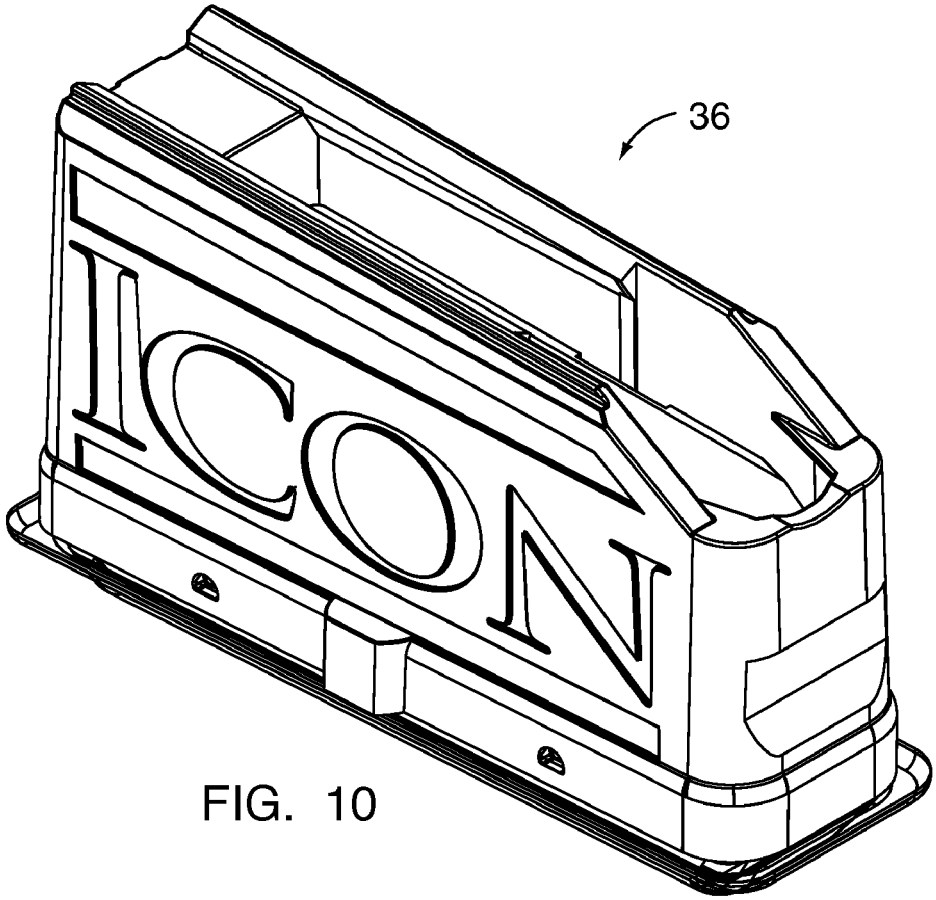
FIG. 10 is a perspective view of a magazine in accordance with the present invention.

With reference to FIG. 6, the safety 34 is a manual feature and is a two position safety as compared to a conventional three position safety. The safety 34 is preferably disposed on the right side of the firearm 10 at the rear of the receiver 42. The safety 34 includes a safety lever 56 which when in a fully rearward position is in an engaged or safe position so as to prevent the trigger 30 from being moved to discharge the firearm 10. The safety lever 56 when in a fully forward position is in a disengaged or "fire" position so as to permit the trigger 30 to be moved to discharge the firearm 10. Preferably a red dot is disposed on the stock 12 and is covered by the safety lever 56 when in the engaged or safe position, and is uncovered and visible to the user when the safety lever 56 is in the engaged or fire position. Hence, the red dock when visible to the user indicates that the firearm 10 is ready to be fired.

The bolt lock 28 is a manual feature and is configured to allow the bolt assembly 16 to be locked in a closed position. This locking feature prevents a potential inadvertent opening of the bolt assembly 16 as the user is walking with the bolt assembly in the closed position. The bolt lock 28 precludes the opening of the bolt assembly 16 while the safety lever 56 is in the safe position. The bolt lock 28 includes a bolt lock lever 58 which when in a fully rearward position is in an engaged or locked position so as to prevent the bolt handle 26 from accidentally being moved and opening the bolt assembly 16. The bolt lock lever 58 when in a fully forward position is in a disengaged or unlocked position so as to enable the bolt handle 26 to be moved to open the bolt assembly 16. The bolt lock 28 is configured to be automatically unlocked when the safety lever 56 is moved to the fire position. More specifically, the safety lever 56 is disposed rearwardly of the bolt lock lever 58 such that when the safety lever 56 is moved forwardly into the disengaged or fire position, the safety lever 56 comes into contact and also moves forwardly the bolt lock lever 58 into the disengaged or unlocked position.

Figure 2A:
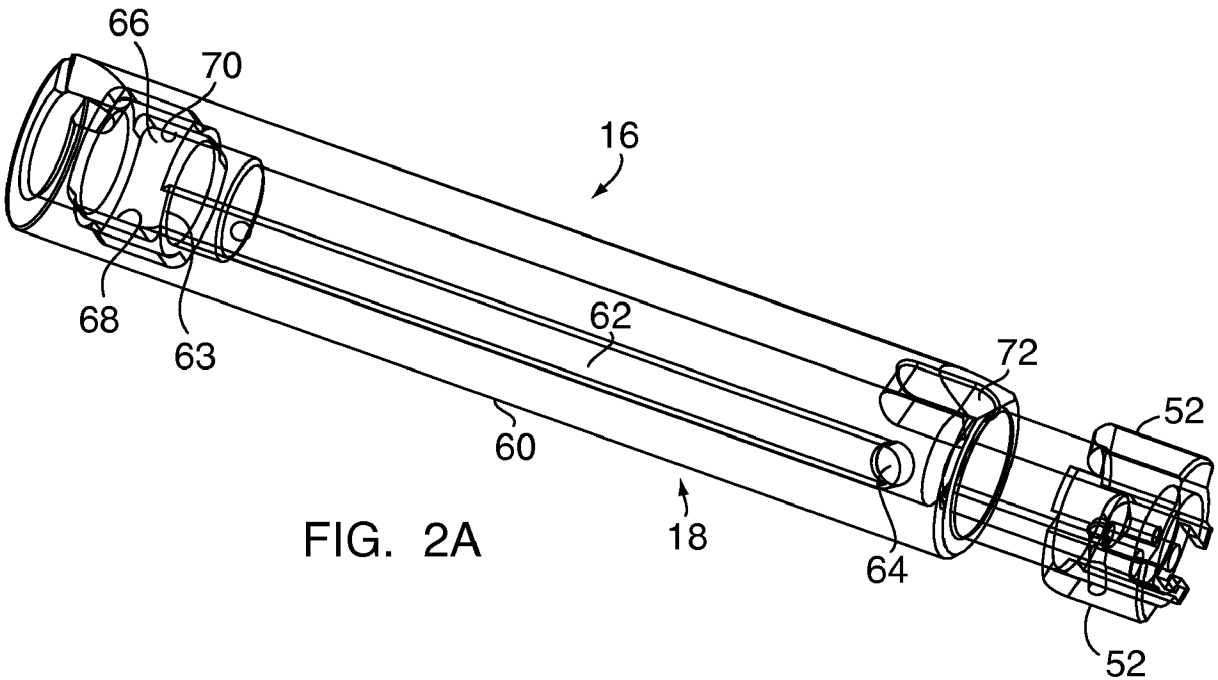
FIG. 2A is a perspective view of a bolt body in accordance with the present invention.
Figure 2B:
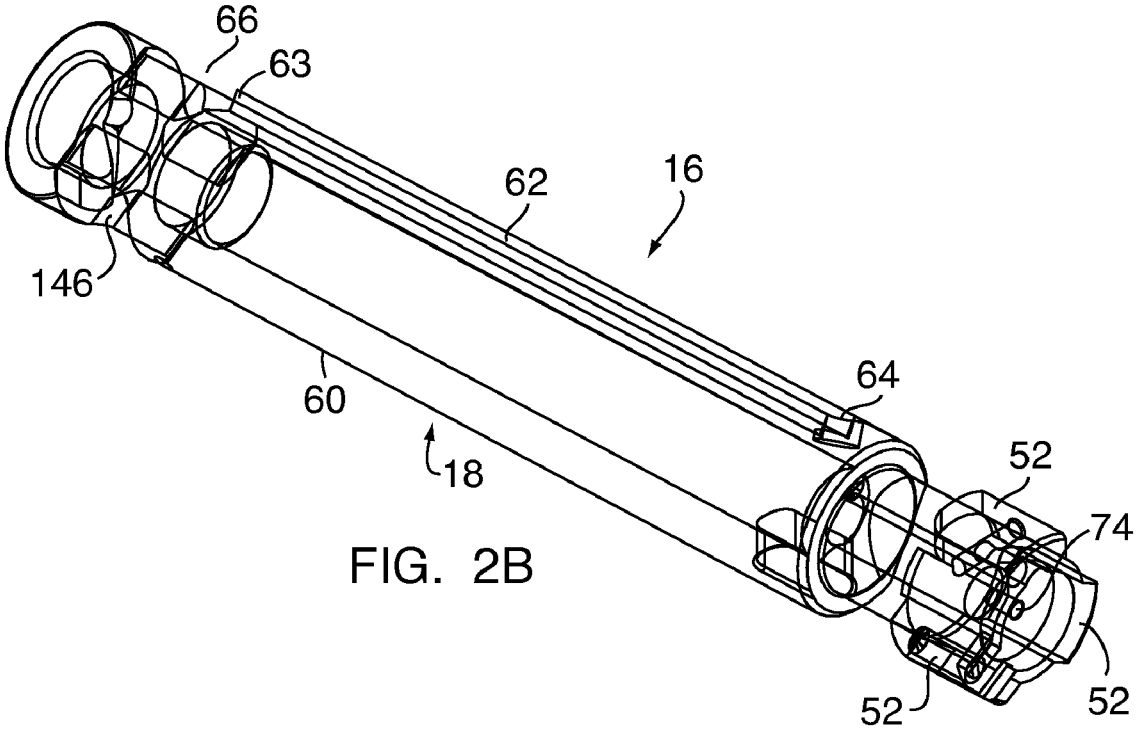
FIG. 2B is another perspective view of the bolt body.
Figure 2C:
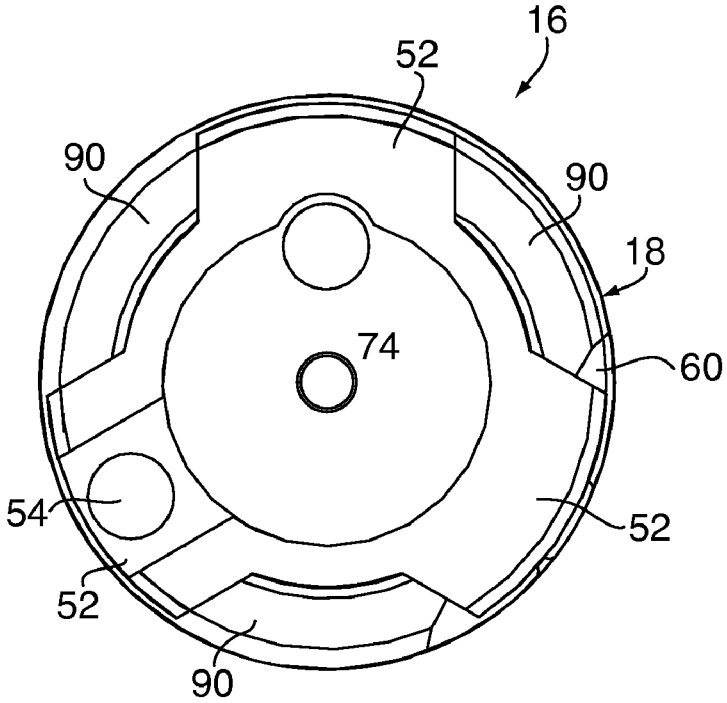
FIG. 2C is a forward end view of the bolt body.

Some of the components of the firearm 10 will now be explained in greater detail. As shown in FIGS. 2A-2C, the bolt body 18 has an outer surface 60 defining a first guide channel 62 extending in a longitudinal direction along the bolt body 18 from a rearward end 63 to a forward end 64. The outer surface 60 of the bolt body 18 further defines a second guide channel 66 extending circumaxially partly about the bolt body 18 from a first end 68 to a second end 70. As best shown in FIG. 2A, the rearward end 63 of the first guide channel 62 is adjacent to or abuts against the first end 68 of the second guide channel 66 for the reason to be explained more fully below.

The outer surface 60 of the bolt body 18 also defines a notch 72 slightly rearward of the forward end 64 for the reason to be explained below. The bolt body 18 further includes three locking lugs 52 extending outwardly from the outer surface 60 of the bolt body at the forward end 64. The three locking lugs 52 are preferably evenly spaced circumferentially about a central longitudinal axis of the bolt body 18. As shown in FIG. 2C, the bolt body 18 defines a longitudinally extending central bore 74 extending from the forward end 64 to the rearward end 63 for accommodating a firing pin assembly.

With reference to FIGS. 3A-3F, the receiver 42 preferably includes integral Weaver® style bases 40 on an upper side thereof for rigid and stable mounting of a scope assembly (not shown). The receiver 42 further defines a central bore 80 longitudinally extending from a forward end 82 to a rearward end 84 for accommodating the bolt body 18, and defines an elongated slot 86 at a bottom side for receiving a magazine therethrough. The receiver 42 has three projections 88 extending inwardly toward the bore 80 and spaced circumaxially about a central longitudinal axis of the bore at a location slightly rearwardly from the forward end 82 of the receiver. The projections 88 are configured to mate with openings 90 between the three locking lugs 52 of the bolt body 18 when the bolt body is in the correct angular orientation within the receiver 42. Similarly, when in the correct angular orientation, the locking lugs 52 are configured to mate with openings 92 between the three projections 88. When moving the bolt body 18 into a fully forward position within the receiver 42, the projections 88 and the openings 92 therebetween enable the locking lugs 52 to pass through and beyond the projections 88 when the bolt body 18 is in the correct angular orientation within the receiver 42. When the bolt body 18 is rotated by the bolt handle 26 into a closed position the locking lugs 52 each move into forward axial alignment with a respective projection 88. In other words, each locking lug 52 has a projection 88 rearwardly abutting the locking lug to partially secure the bolt body 18 in a fully forward position within the receiver 42.

Figure 3A:
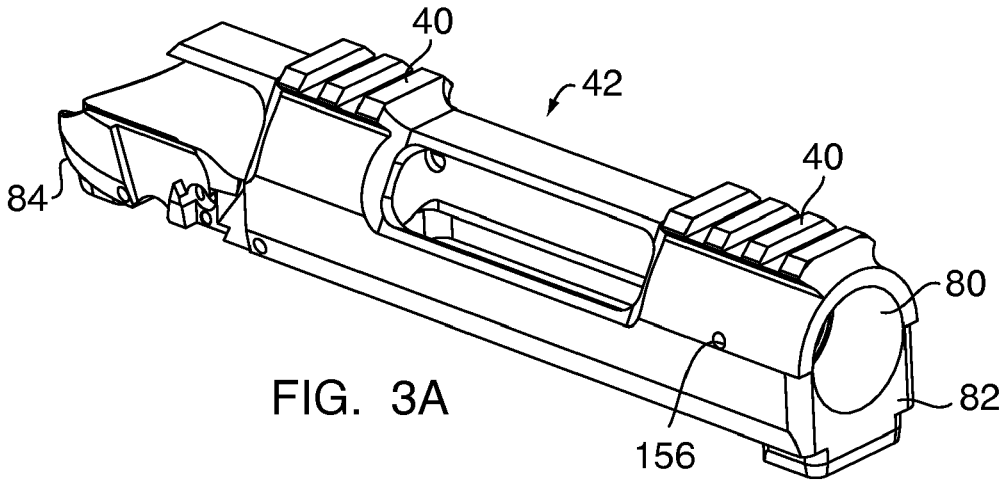
FIG. 3A is a top perspective view of a receiver in accordance with the present invention.
Figure 3B:
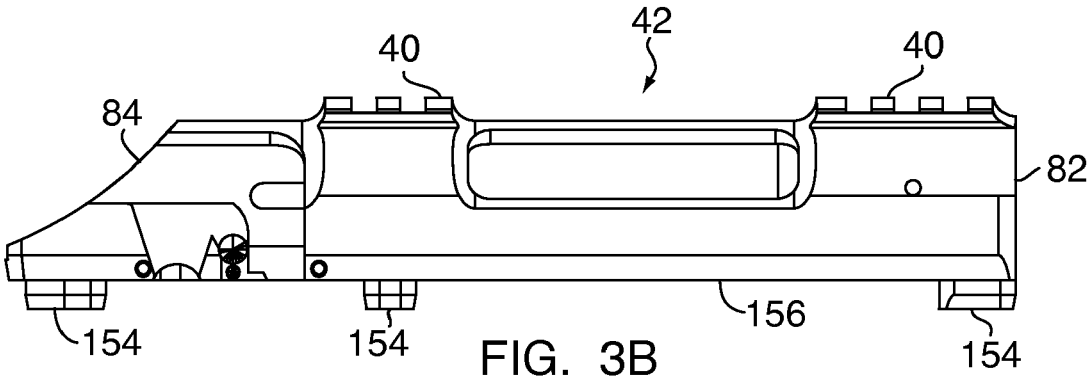
FIG. 3B is a right side elevation view of the receiver.
Figure 3C:
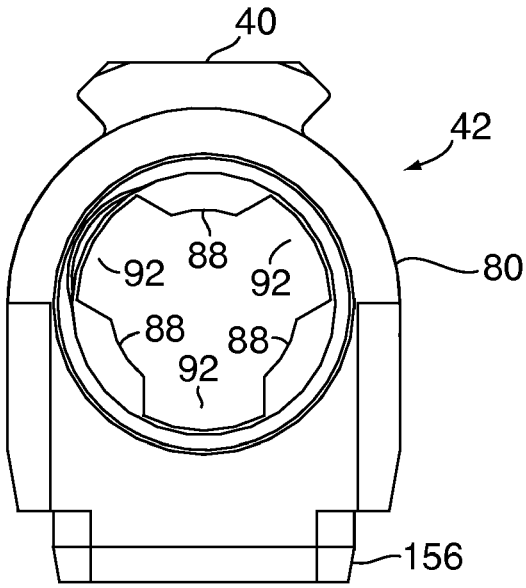
FIG. 3C is a forward end view of the receiver.
Figure 3D:
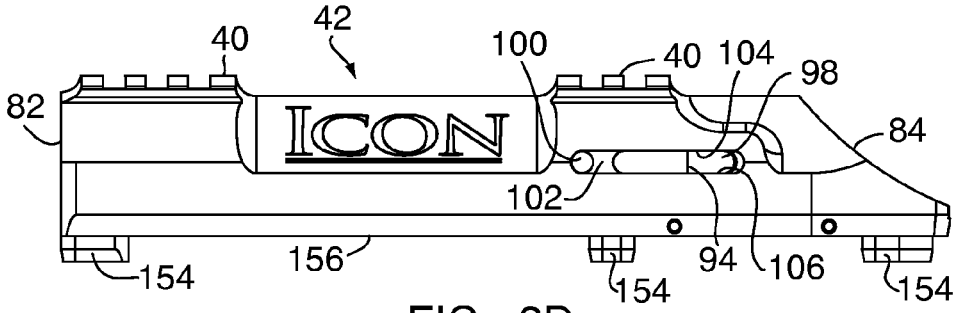
FIG. 3D is a left side elevation view of the receiver.
Figure 3E:
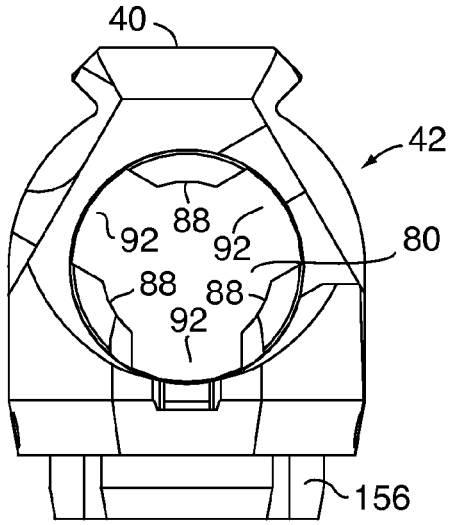
FIG. 3E is a rearward end view of the receiver.
Figure 3F:
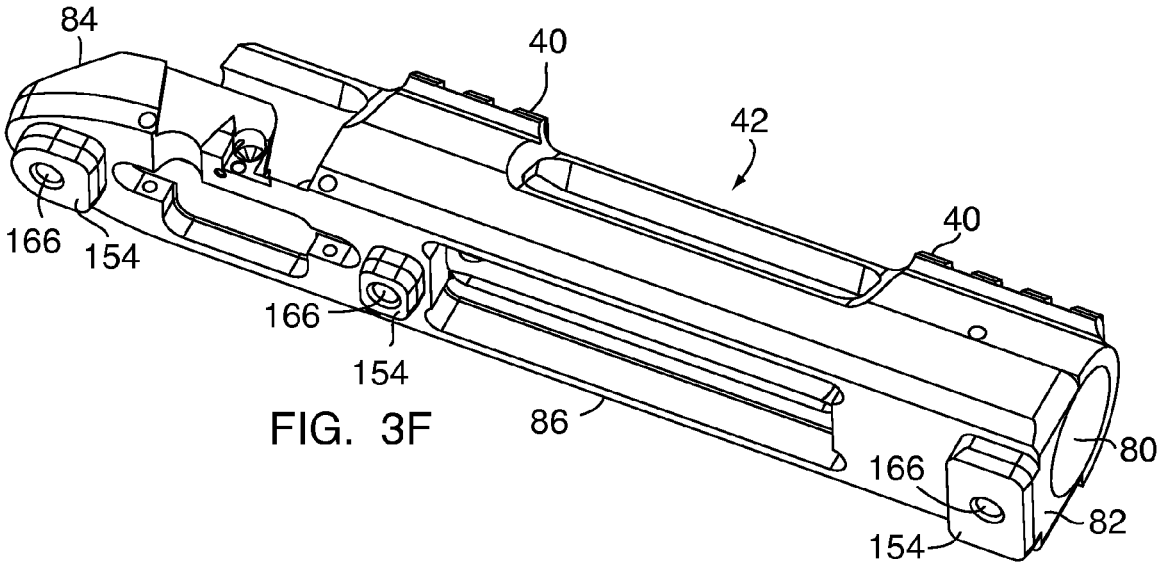
FIG. 3F is a bottom perspective view of the receiver.

The receiver 42 further defines an opening 94 on a left side thereof for accommodating a bolt guide 96 and for exposing a portion of the bolt body 18 for guiding contact with the bolt guide. As shown in FIG. 3D, the opening 94 includes a slot 98 extending in a longitudinal direction along the receiver 42, and a hole 100 disposed slightly forwardly along the receiver 42 relative to the slot 98. The receiver 42 includes a slightly recessed partition 102 disposed between the hole 100 and the slot 98. The opening 94 further defines an upper ledge 104 and a lower ledge 106. The upper and lower ledges 104, 106 define coaxially aligned holes 108 for receiving a pivot pin or fulcrum 110 of the bolt guide 96.

In order to prevent damage to the wood of the stock 12, the bolt body 18 must be rotated into a predetermined correct angular orientation for allowing the bolt body to be inserted into and removed from the receiver 42. To ensure the correct orientation, the bolt body 18 must be coaxially aligned within the receiver 42 such that the bolt guide 96 engages and travels in the first and second guide channels 62, 66 of the bolt body 18.

As shown in FIGS. 7A-7C and 8A-8B, the bolt guide 96 includes an elongated lever or body portion 112 having a first longitudinal end 114 and a second longitudinal end 116. The body portion 112 has a first projection 118 at the first longitudinal end 114, and a second projection 120 at the second longitudinal end 116. The first and second projections 118, 120 each are configured to extend inwardly toward an opposing outer surface of the bolt body 18. The body portion 112 of the bolt guide 96 defines a bore 122 extending therethrough from a lower end 124 to an upper end 126. The bore 122 is disposed along the body portion 112 so as to coaxially align with the holes 108 defined by the upper and lower ledges 104,106 of the receiver 42. The pivot pin or fulcrum 110 of the bolt guide 96 is received in the bore 122 and secured to the receiver 42 by receiving one end of the pivot pin in the hole 108 defined by the upper ledge 104, and receiving the other end of the pivot pin in the hole 108 defined by the lower ledge 106.

A bottom surface 128 of the body portion 112 of the bolt guide 96 defines a recessed portion 130 for partially accommodating one end 132 of a resilient member 134 such as coil spring. Another end 136 of the resilient member 134 abuts against the partition 102 between the hole 100 and the slot 98 defined in the receiver 42. The resilient member 134 is tensioned between the body portion 112 of the bolt guide 96 and the partition 102 of the receiver 42. The resilient member 134 biases the body portion 112 to pivot about the pivot pin or fulcrum 110 such that the second longitudinal end 116 of the body portion 112 moves inwardly toward the bolt body 18. As a result, the second projection 120 of the body portion 112 of the bolt guide 96 disposed in the slot 98 is urged against the bolt body 18 for the reason to be explained more fully below.

When the bolt body 18 is in a fully-inserted or forward position within the receiver 42, the second projection 120 of the bolt guide 96 is disposed in the second guide channel 66 of the bolt body 18. As the bolt handle 26 is rotated upwardly to an open position, the bolt body 18 is rotated relative to the bolt guide 96 such that the second projection 120 travels in the second guide channel 66 from the second end 70 to the first end 68. In the open position, the first projection 118 of the bolt guide 96 moves into the first guide channel 62 of the bolt body 18. The bolt body 18 can then be pulled by the bolt handle 26 rearwardly out of the receiver 42 which caused the second projection 120 of the bolt guide 96 to move from the first end 68 of the second guide channel 66 into the rearward end 63 of the first guide channel 62. The first and second projections 118,120 of the bolt guide 96 then travel from the rearward end 63 toward the forward end 64 of the first guide channel 62. The first projection 118 is configured to move up and out of the first guide channel 62 when reaching the forward end 64 of the first guide channel. The second projection 120 is configured to abut against the forward end 64 of the first guide channel 62 and thereby prevent the bolt body 18 from being completely removed from the receiver 42. This preventive measure is necessary when the bolt body 18 is being moved to reload the firearm 10.

If the user desires the bolt body 18 to be fully removed from the receiver 42 during a disassembly, the first longitudinal end 114 of the bolt guide 18 is manually pushed such that the body portion 112 of the bolt guide pivots against tension of the resilient member 134 to move the second projection 120 at the second longitudinal end 116 outwardly and out of engagement with the first guide channel 62, thereby freeing the bolt body 18 to continue moving rearwardly beyond the bolt guide 96 and out of the receiver 42 during disassembly. The notch 72 defined in the outer surface 60 of the bolt body 18 provides further clearance for bolt guide 96 to travel over when being disengaged from the bolt body. For assembly, the above-mentioned process generally is reversed.

As shown in FIG. 4, the bolt handle 26 is configured to be interchangeable with bolt handles of other styles. The bolt handle 26 includes a bolt engagement end 138 and a grip end 140. The bolt engagement end 138 defines a generally semi-circular or concave surface 142 shaped for mating with a cylindrical outer surface of the bolt body 18. The bolt engagement end 138 further defines two generally linear extensions 144 each projecting outwardly from an end of the concave surface 142 for being received in a slot 146 defined by the bolt body 18. The bolt handle 26 is engaged with the bolt body 18 by placing the linear extensions 144 within the slot 146 defined by the bolt body 18. The linear extensions 144 are held in place under spring tension from the firing pin assembly 76 disposed in the longitudinally extending central bore 74 defined by the bolt body 18.

As shown in FIG. 4, the bolt handle 26 further defines a notch 148 between the bolt engagement end 138 and the grip end 140 for accommodating the bolt lock 28. The bolt lock 28 when moved into the notch 148 to engage the bolt handle 26 is an immovable obstacle preventing the bolt handle from accidentally moving with the undesirable consequence of rotating the bolt body 18 from a closed position to an open position.

Figure 5A:
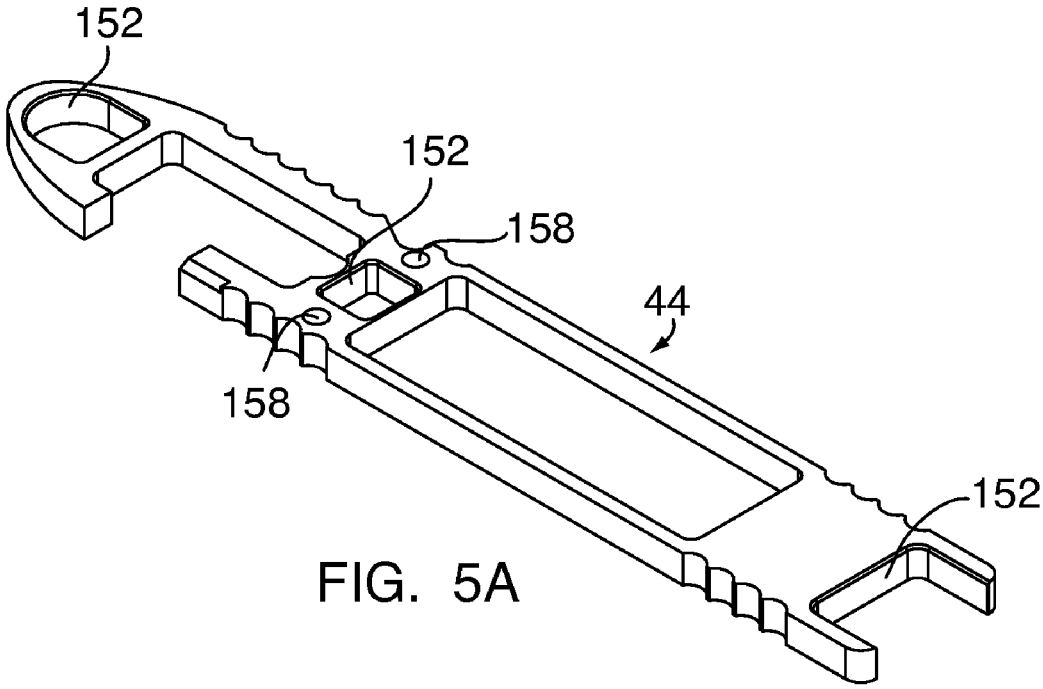
FIG. 5A is a perspective view of a bedding block in accordance with the present invention.
Figure 5B:
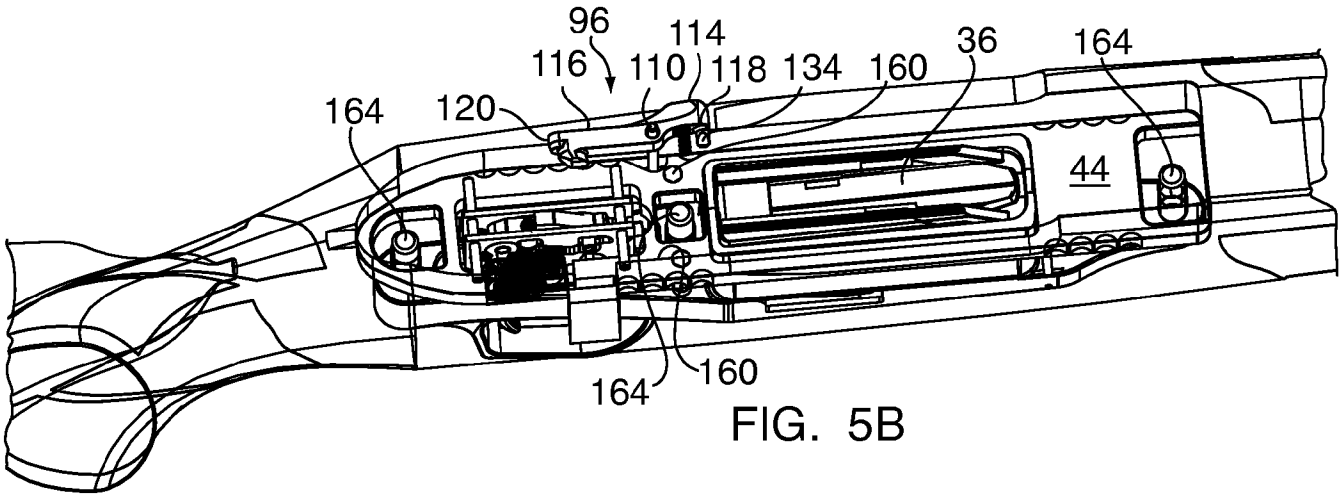
FIG. 5B is a top perspective view of the bedding block mounted on the stock of the rifle.

The receiver 42 is coupled to the stock 12 via the bedding block 44. As shown in FIG. 5A, the bedding block 44 is preferably made of durable aluminum and defines three openings 152 spaced along a length of the bedding block for receiving recoil lugs 154 from a bottom side 156 of the receiver 42. The recoil lugs 154 are preferably of integral construction with the body of the receiver 42. The bedding block 44 further defines holes 158 to be inserted on positioning pins 160 extending upwardly from a recessed portion of the stock 12 for properly securably positioning of the bedding block on the stock. FIG. 5B shows the bedding block 44 when properly secured to and positioned on the recessed portion of the stock 12. As also shown in FIG. 5B, the openings 152 of the bedding block when positioned on the recessed portion of the stock 12 each accommodate a positioning pin 164 such as a bolt extending upwardly from the stock 12 for the reason to be explained below.

The bottom side 156 of the receiver 42 defines three integral recoil lugs 154 spaced along a length of the receiver. The recoil lugs 154 are each spaced and configured for being securably received into a corresponding one of the openings 152 defined by the bedding block 44. The shape of the openings 152 defined by the bedding block 44 and the shape of the recoil lugs 154 are configured to mate with one another to ensure precise, tight and secure positioning of the receiver 42 onto the bedding block 44. The recoil lugs 154 each define a hole 166 in a center portion thereof to be securably received over a corresponding one of the positioning pins 164 extending upwardly from the stock 12 and through the openings 152 of the bedding block 44 for ensuring that the stock 12, bedding block 44 and the receiver 42 are precisely interlocked and secured to one another.

Although the invention has been described and illustrated with respect to an exemplary embodiment thereof, the foregoing and various other additions and omissions may be made therein and thereto without departing from the spirit and scope of the present invention.

What is claimed is:

1. A bolt action firearm, comprising:

a bolt assembly including a bolt body having an outer surface defining a longitudinal guide channel extending along a length of the bolt body from a rearward end to a forward end;

a receiver defining a central longitudinally extending bore for accommodating the bolt body; and a bolt guide to be coupled to the receiver, the bolt guide including a projection configured for traveling in the guide channel when moving the bolt body in the receiver so as to ensure that the bolt body is at a predetermined correct angular orientation within the receiver;

wherein the outer surface of the bolt body further defines a second guide channel adjacent to a rearward end of the longitudinal guide channel and extending circumaxially partly about the bolt body, the projection of the bolt guide being configured for traveling in the second guide channel to enable the bolt body to be rotated between open and closed positions when the bolt body is fully inserted within the receiver.

2. A bolt action firearm, comprising:

a bolt assembly including a bolt body having an outer surface defining a longitudinal guide channel extending along a length of the bolt body from a rearward end to a forward end;

a receiver defining a central longitudinally extending bore for accommodating the bolt body; and a bolt guide to be coupled to the receiver, the bolt guide including a projection configured for traveling in the guide channel when moving the bolt body in the receiver so as to ensure that the bolt body is at a predetermined correct angular orientation within the receiver;

wherein the bolt body includes three locking lugs extending outwardly from and spaced circumaxially about the outer surface of the bolt body at the forward end thereof.

3. A bolt action firearm as defined in claim 2, wherein the receiver includes three projections disposed slightly rearwardly of a forward end of the receiver, the projections extending inwardly toward and spaced circumaxially about the bore of the receiver, the projections being configured to mate with openings defined between the locking lugs, and the locking lugs being configured to mate with openings defined between the projections such that the locking lugs are enabled to pass through and beyond the projections when the bolt body is in a correct angular orientation within the receiver.

4. A bolt action firearm as defined in claim 2, wherein one of the locking lugs includes an extractor so as to form a solid ring of steel for uniformly supporting a case head.

5. A bolt action firearm, comprising:

a bolt assembly including a bolt body having an outer surface defining a longitudinal guide channel extending along a length of the bolt body from a rearward end to a forward end;

a receiver defining a central longitudinally extending bore for accommodating the bolt body; and a bolt guide to be coupled to the receiver, the bolt guide including a projection configured for traveling in the guide channel when moving the bolt body in the receiver so as to ensure that the bolt body is at a predetermined correct angular orientation within the receiver;

wherein the bolt guide is pivotally coupled to the receiver to enable the projection of the bolt guide manually to be pivoted out of the guide channel when the bolt body is removed from the receiver.

6. A bolt action firearm as defined in claim 5, wherein the bolt body defines a notch slightly rearwardly of the forward end to provide further clearance for the bolt guide to travel over when being disengaged from the bolt body.

7. A bolt action firearm, comprising:

a bolt assembly including a bolt body having an outer surface defining a longitudinal guide channel extending along a length of the bolt body from a rearward end to a forward end;

a receiver defining a central longitudinally extending bore for accommodating the bolt body;

a bolt guide to be coupled to the receiver, the bolt guide including a projection configured for traveling in the guide channel when moving the bolt body in the receiver so as to ensure that the bolt body is at a predetermined correct angular orientation within the receiver;

a bolt handle having a bolt engagement end and a grip end, the bolt engagement end defining a generally concave surface shaped for mating with the outer surface of the bolt body, and the bolt engagement end defining two extensions each projecting outwardly from an end of the concave surface; and the outer surface of the bolt body defining a slot configured for receiving therein the two extensions of the engagement end of the bolt handle.

8. A bolt action firearm as defined in claim 1, further comprising a two position safety having a safety lever configured such that when in a fully rearward position is in an engaged or safe position to prevent a trigger from moving, and configured such that when in a fully forward position is in a disengaged or fire position.

9. A bolt action firearm, comprising:

a bolt assembly including a bolt body having an outer surface defining a longitudinal guide channel extending along a length of the bolt body from a rearward end to a forward end;

a receiver defining a central longitudinally extending bore for accommodating the bolt body;

a bolt guide to be coupled to the receiver, the bolt guide including a projection configured for traveling in the guide channel when moving the bolt body in the receiver so as to ensure that the bolt body is at a predetermined correct angular orientation within the receiver;

a two position safety having a safety lever configured such that when in a fully rearward position is in an engaged or safe position to prevent a trigger from moving, and configured such that when in a fully forward position is in a disengaged or fire position; and a bolt lock configured to allow the bolt assembly to be locked in a closed position, the bolt lock including a bolt lock lever configured such that when in a fully rearward position is in an engaged or locked position to prevent a bolt handle from accidentally being moved and opening the bolt assembly, and the bolt lock lever being configured such that when in a fully forward position is in a disengaged or unlocked position so as to enable a bolt handle to be moved to open the bolt assembly.

10. A bolt action firearm as defined in claim 9, wherein safety lever is disposed rearwardly of the bolt lock lever such that when the safety lever is moved forwardly into the disengaged or fire position, the safety lever comes into contact and also moves forwardly the bolt lock lever into the disengaged or unlocked position.

11. A bolt action firearm as defined in claim 1, wherein the receiver defines an integral base on an upper side thereof for rigid and stable mounting of a scope assembly.

12. A bolt action firearm as defined in claim 1, further comprising a bedding block for the receiver, the bedding block defining three openings spaced along a length, and wherein a bottom side of the receiver includes three recoil lugs configured for being received into the openings of the bedding block.

13. A bolt action firearm as defined in claim 12, wherein the bedding block defines holes configured for being inserted on positioning pins extending upwardly from a stock.

14. A bolt action firearm as defined in claim 12, wherein the recoil lugs each define a hole in a center portion thereof which is configured to be securably received over a positioning pin extending upwardly from a stock.

15. A bolt action firearm as defined in claim 12, wherein a shape of the openings defined by the bedding block and a shape of the recoil lugs are configured to mate with one another for proper positioning of the receiver on the bedding block.

* * * * *